US012434795B2

(12) United States Patent
Kaiser et al.

(10) Patent No.: US 12,434,795 B2
(45) Date of Patent: Oct. 7, 2025

(54) SEMI-FLEXIBLE INSTRUMENTATION MOUNT

(71) Applicant: Saildrone, Inc., Alameda, CA (US)

(72) Inventors: Carl Kaiser, Alameda, CA (US); Mikael Bishop, Alameda, CA (US); Richard Jenkins, Alameda, CA (US); Oscar Viquez, Alameda, CA (US); John McGunnigle, Alameda, CA (US)

(73) Assignee: Saildrone, Inc., Alameda, CA (US)

( * ) Notice: Subject to any disclaimer, the term of this patent is extended or adjusted under 35 U.S.C. 154(b) by 207 days.

(21) Appl. No.: 18/338,155

(22) Filed: Jun. 20, 2023

(65) Prior Publication Data

US 2024/0317365 A1 Sep. 26, 2024

Related U.S. Application Data

(60) Provisional application No. 63/492,214, filed on Mar. 24, 2023.

(51) Int. Cl.
*B63B 32/77* (2020.01)

(52) U.S. Cl.
CPC ..... *B63B 32/77* (2020.02)

(58) Field of Classification Search
CPC ..... B63B 32/77
See application file for complete search history.

(56) References Cited

U.S. PATENT DOCUMENTS

| | | | | |
|---|---|---|---|---|
| 10,272,979 | B2 * | 4/2019 | Duckworth | B63J 3/04 |
| 10,703,444 | B2 | 7/2020 | Dane | |
| 10,773,591 | B2 * | 9/2020 | Yeomans | B60K 28/04 |
| 11,697,478 | B2 * | 7/2023 | Grall | B63B 27/36 114/321 |
| 2014/0169125 | A1 * | 6/2014 | Voisin | G01V 1/38 367/18 |
| 2014/0245943 | A1 * | 9/2014 | Swan | B63B 32/40 114/345 |
| 2016/0229498 | A1 * | 8/2016 | Olsen | B63B 32/77 |
| 2017/0043846 | A1 * | 2/2017 | Elkinton | B63B 32/77 |
| 2017/0282051 | A1 * | 10/2017 | Meyer | A63C 17/014 |
| 2018/0178887 | A1 * | 6/2018 | Pacini | B63C 9/11 |
| 2019/0092434 | A1 * | 3/2019 | Mellina | B63B 32/40 |
| 2022/0024548 | A1 * | 1/2022 | Cohen | B63H 21/17 |

* cited by examiner

*Primary Examiner* — Derek J Battisti
(74) *Attorney, Agent, or Firm* — Wei IP Law, PC

(57) ABSTRACT

Techniques are provided for a semi-flexible instrumentation mount for coupling an instrumentation module to a mounting location disposed on an aquatic vehicle. The semi-flexible instrumentation mount includes a support assembly comprising one or more support assembly components. The support assembly is configured to couple with the mounting location disposed on the aquatic vehicle. The semi-flexible instrumentation mount also includes an elastomeric segment comprising a vehicle end and an instrumentation end, a first rigid connector configured to couple the vehicle end of the elastomeric segment with the support assembly, and a second rigid connector configured to couple the instrumentation end of the elastomeric segment with the instrumentation module.

20 Claims, 3 Drawing Sheets

SEMI-FLEXIBLE INSTRUMENTATION MOUNT

CROSS-REFERENCE TO RELATED APPLICATIONS; BENEFIT CLAIM

This application claims the benefit of Provisional Application Ser. No. 63/492,214, filed Mar. 24, 2023, the entire contents of which are hereby incorporated by reference as if fully set forth herein, under 35 U.S.C. § 119(e).

FIELD OF THE DISCLOSURE

The present disclosure generally relates to aquatic vehicles, and relates more specifically to a semi-flexible instrumentation mount.

BACKGROUND

Underwater detection systems such as Sound Navigation and Ranging (sonar) are commonly used in various applications such as marine navigation, ocean research, surveillance, and data collection for other purposes. Sonar may be deployed from manned research vessels. Manned research vessels are typically costly to operate due to a combination of factors, such as crew, fuel, maintenance, and other operational costs. Furthermore, missions may be performed at remote locations that require long deployment times, increasing their cost and complexity. The use of unmanned autonomous vehicles to collect sonar data is limited. For example, sonar may be used in challenging or severe marine environments where the vehicle and/or equipment are exposed to high winds, heavy seas, strong currents, extreme temperatures, corrosive saltwater, and other environmental factors that can cause equipment failures. A human operator on a manned research vessel may perform maintenance and repairs to restore functionality to equipment that, without intervention, would be inoperable for the remainder of the mission. Furthermore, a human operator on a manned research vessel may make navigational decisions that can minimize the exposure of instrumentation to impact, forces, or other stressors in such environments.

During a mission, sonar equipment can be susceptible to damage, such as impact damage due to underwater obstructions or debris, impact damage from waves or currents, water pressure damage, corrosion, electrical damage, other environmental damage, and wear and tear from prolonged use. Protecting equipment from damage and loss is essential to the success of a mission. This is particularly important in uncrewed systems, since a failure may not be quickly detected and resolved by a human operator. Systems, devices, and methods described herein can be used to address these and other issues.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

The appended claims may serve as a summary of the invention.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not to be considered limiting of its scope, the invention will be described and explained with additional specificity and detail through the use of the accompanying drawings in which.

Figure 1:
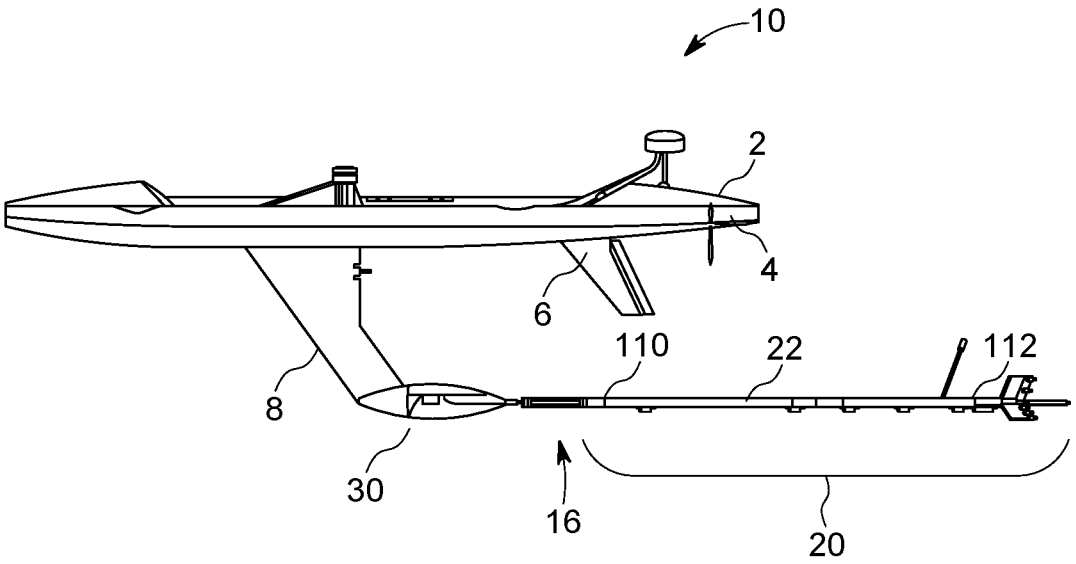
FIG. 1 is a perspective view of an aquatic vehicle with a semi-flexible instrumentation mount coupling an instrumentation module to the aquatic vehicle in an example embodiment.

While each of the drawing figures illustrates a particular embodiment for the purpose of illustrating a clear example, other embodiments may omit, add to, reorder, or modify any of the elements shown in the drawing figures. For purposes of illustrating clear examples, one or more figures may be described with reference to one or more other figures, but using the particular arrangement illustrated in one or more other figures is not required in other embodiments.

DETAILED DESCRIPTION

In the following description, numerous specific details are set forth in order to provide a more thorough understanding of the subject matter of the present application. It will be apparent, however, to a person of ordinary skill that embodiments may be practiced without incorporating all aspects of the specific details described herein. In other instances, specific features, quantities, or measurements well known to those of ordinary skill in the art have not been described in detail so as not to obscure the disclosure. Readers should note that although examples are set forth herein, the claims, and the full scope of any equivalents, are what define the metes and bounds of the disclosure. Furthermore, a person of ordinary skill in the art will recognize that methods and processes described herein may be performed in a different order, in series, and/or in parallel without departing from the spirit or the scope of the disclosure.

It will be further understood that: the term "or" may be inclusive or exclusive unless expressly stated otherwise; the term "set" may comprise zero, one, or two or more elements; the terms "first", "second", "certain", and "particular" are used as naming conventions to distinguish elements from each other does not imply an ordering, timing, or any other characteristic of the referenced items unless otherwise specified; the term "and/or" as used herein refers to and encompasses any and all possible combinations of one or more of the associated listed items; that the terms "comprises" and/or "comprising" specify the presence of stated feature/s, but do not preclude the presence or addition of one or more other features.

General Overview

This document generally describes systems, methods, devices, and other techniques for a semi-flexible instrumentation mount. The semi-flexible instrumentation mount couples an instrumentation module to an aquatic vehicle in a manner that stabilizes the instrumentation module during operation of the aquatic vehicle. The semi-flexible instrumentation mount may also reduce structural forces on components of a mechanical system that includes the aquatic vehicle, the semi-flexible instrumentation mount, and the instrumentation module. These properties of the semi-flexible instrumentation mount may facilitate deployment of the instrumentation module in more extreme environments and/or under lower supervision, including deployment on unmanned vehicles on lengthy missions without human intervention or routine maintenance. Additional features and advantages are apparent from the specification and the drawings.

One aspect of the disclosure is directed to a semi-flexible instrumentation mount for coupling an instrumentation module to a mounting location disposed on an aquatic vehicle, the semi-flexible instrumentation mount comprising: a support assembly comprising one or more support assembly components, the support assembly configured to couple with the mounting location disposed on the aquatic vehicle; an elastomeric segment comprising a vehicle end and an instrumentation end; a first rigid connector configured to couple the vehicle end of the elastomeric segment with the support assembly; and a second rigid connector configured to couple the instrumentation end of the elastomeric segment with the instrumentation module.

In some embodiments, a longitudinal axis of the first rigid connector, a longitudinal axis of the second rigid connector, and a longitudinal axis of the elastomeric segment are aligned.

In some embodiments, the elastomeric segment comprises a neoprene sleeve. As an addition or alternative, the first rigid connector comprises a first bolt comprising a first shank that is at least partially threaded, and the first rigid connector is configured to couple with the vehicle end of the elastomeric segment by rotational insertion of a threaded end of the first shank into the vehicle end of the elastomeric segment. As an addition or alternative, the first rigid connector is configured to couple with the support assembly at a fastening location disposed on the support assembly, the fastening location comprising a bolt hole. As an addition or alternative, the second rigid connector comprises a second bolt comprising a second shank that is at least partially threaded, and the second rigid connector is configured to couple with the instrumentation end of the elastomeric segment by rotational insertion of a threaded end of the second shank into the instrumentation end of the elastomeric segment. As an addition or alternative, the second rigid connector is configured to couple with the instrumentation module through a bolt hole of a body insert configured to couple with the instrumentation module. As an addition or alternative, the body insert is configured to insert into a mounting end of an instrumentation module body comprising a tube.

In some embodiments, the mounting location is disposed on a lower end of a keel of the aquatic vehicle. As an addition or alternative, the semi-flexible instrumentation mount includes a keel bulb configured to cover the mounting location and the support assembly.

One aspect of the disclosure is directed to an instrumentation assembly configured to mount to a mounting location disposed on an aquatic vehicle, the instrumentation assembly comprising: an instrumentation module comprising an instrumentation module body; a semi-flexible instrumentation mount for coupling a mounting end of the instrumentation module body to the mounting location of the aquatic vehicle, the semi-flexible instrumentation mount comprising: a support assembly comprising one or more support assembly components, the support assembly configured to couple with the mounting location disposed on the aquatic vehicle; an elastomeric segment comprising a vehicle end and an instrumentation end; a first rigid connector configured to couple the vehicle end of the elastomeric segment with the support assembly; and a second rigid connector configured to couple the instrumentation end of the elastomeric segment with a mounting end of the instrumentation module body.

In some embodiments, a longitudinal axis of the first rigid connector, a longitudinal axis of the second rigid connector, a longitudinal axis of the elastomeric segment, and a longitudinal axis of the instrumentation module body are aligned.

In some embodiments, the elastomeric segment comprises a neoprene sleeve. As an addition or alternative, the first rigid connector comprises a first bolt comprising a first shank that is at least partially threaded; the first rigid connector is configured to couple with the vehicle end of the elastomeric segment by rotational insertion of a threaded end of the first shank into the vehicle end of the elastomeric segment; the second rigid connector comprises a second bolt comprising a second shank that is at least partially threaded; and the second rigid connector is configured to couple with the instrumentation end of the elastomeric segment by rotational insertion of a threaded end of the second shank into the instrumentation end of the elastomeric segment.

In some embodiments, the mounting location is disposed on a lower end of a keel of the aquatic vehicle. As an addition or alternative, the instrumentation assembly further comprises a keel bulb configured to cover the mounting location and the support assembly.

In some embodiments, the instrumentation module includes a first plurality of hydrophones arranged in a linear array along a lower surface of the instrumentation module body.

In some embodiments, the instrumentation module includes a second plurality of hydrophones arranged in a tetrahedral array along a tetrahedral sonar array module coupled with a free end of the instrumentation module body. As an addition or alternative, the second plurality of hydrophones are arranged on a tetrahedral frame comprising three hydrofoil elements.

In some embodiments, further comprising an Attitude and Heading Reference System (AHRS) configured to determine an orientation of the instrumentation module body.

System Overview

FIG. 1 is a perspective view of an aquatic vehicle with a semi-flexible instrumentation mount coupling an instrumentation module to the aquatic vehicle in an example embodiment. A semi-flexible instrumentation mount 16 couples an instrumentation module 20 to an aquatic vehicle 10. The aquatic vehicle 10 may be any type of vehicle that is designed to travel on or through a body of water. An aquatic vehicle 10 may be used for a wide range of purposes, such as but not limited to transportation, recreation, research, fishing, other commercial activities, or any other purpose. An aquatic vehicle 10 may operate in a variety of conditions and environments, ranging from lakes and rivers to rough seas and oceans. In some embodiments, the aquatic vehicle 10 is an unmanned vehicle, such as an unmanned surface vehicle (USV) or an unmanned undersea vehicle (UUV).

The aquatic vehicle 10 includes a vehicle body 2 comprising a hull 4. The hull 4 of the aquatic vehicle 10 may include one or more portions of the vehicle body 2 that are below the water line during typical operation of the aquatic vehicle 10. The hull 4 is typically a watertight enclosure, which may be open or sealed. The vehicle body 2 has a primary axis that runs longitudinally from a front end of the vehicle body 2 to a rear end of the vehicle body 2. While one vehicle body 2 and one hull 4 are illustrated, an aquatic vehicle 10 may include multiple vehicle bodies 2 and/or hulls 4 without departing from the spirit or the scope of the disclosure. A person of ordinary skill would recognize how to adapt techniques described herein with respect to a semi-flexible instrumentation mount to an aquatic vehicle 10 with multiple vehicle bodies 2 and/or hulls 4.

The aquatic vehicle 10 may further include a rudder 6. The rudder 6 is configured to control the direction of movement of the aquatic vehicle 10 through the water, typically by rotating to control the direction of water passing over the rudder 6. As shown, the rudder 6 is coupled to the hull 4, but one or more rudders may be coupled with any underwater surface of aquatic vehicle 10 without departing from the spirit or the scope of the disclosure.

The aquatic vehicle 10 may further include a keel 8 coupled with the vehicle body 2 at a first end of the keel 8. For example, the keel 8 may extend from the hull 4 at or near a centerline of the vehicle body 2. A keel 8 is typically a hydrodynamic structure that improves stability and maneuverability of the aquatic vehicle 10. In some embodiments, the keel 8 is removably coupled with the vehicle body 2, such as to facilitate transportation, repair, storage, or any other function. As shown, one keel 8 is coupled to the vehicle body 2, but one or more keels 8 may be coupled with any underwater surface of aquatic vehicle 10 without departing from the spirit or the scope of the disclosure. In some embodiments, the keel 8 includes sufficient ballast to provide a positive righting moment when the vehicle body 2 is rotated to any angle about its primary axis. For example, the keel 8 may include sufficient ballast to passively right the aquatic vehicle 10 from any position to prevent the aquatic vehicle 10 from staying in a capsized position during normal operation of the aquatic vehicle 10. Suitable ballast may include lead, concrete, steel, iron, or any other high-density material suitable for use as ballast. The ballast may fill at least a portion of an interior of the keel 8.

The semi-flexible instrumentation mount 16 couples the instrumentation module 20 to the aquatic vehicle 10 at a mounting location 30 disposed on the aquatic vehicle 10. The instrumentation module 20 may include one or more instruments configured to collect data while submerged underwater, such as but not limited to one or more acoustic instruments, as described in greater detail hereinafter. As used herein, the term "instrument" refers to any device or tool that is configured to measure, observe, analyze, or control a physical quantity or phenomenon. In some embodiments, the instrumentation module 20 includes a passive acoustic array comprising multiple passive acoustic instruments.

The instrumentation module 20 includes an instrumentation module body 22. One or more instruments of the instrumentation module 20 may be coupled to the instrumentation module body 22. An instrument may be coupled with the instrumentation module body 22 using one or more attachment features and/or methods, such as but not limited to one or more mounts, mounting components, bolts, nuts, screws, rivets, clamps, fasteners, hooks, latches, pins, springs, mounts, interlocking features, magnets, other fasteners, adhesives, bonding agents, heat, welding, soldering, press fitting, friction fitting, and/or any other suitable attachment feature or method. In some embodiments, at least a portion of the instrumentation module body 22 is hollow. For example, the instrumentation module body 22 may comprise a cylinder with a hollow channel running through at least a portion of the instrumentation module body 22. In some embodiments, wiring for one or more instruments of the instrumentation module 20 may be run through a channel within the instrumentation module body 22. The instrumentation module body may be made of any suitable material, such as but not limited to aluminum, stainless steel, other metals, fiberglass, carbon fiber, resins, composites, other suitable materials, and/or any combination thereof. In some embodiments, the instrumentation module body 22 comprises a fiberglass tube.

In some embodiments, the instrumentation module 20 includes an Attitude and Heading Reference System (AHRS) configured to measure and report an orientation of the instrumentation module 20. The semi-flexible instrumentation mount 16 may flex in response to various forces, resulting in an angular range of movement of the instrumentation module 20, causing it to deviate from the mounting axis 24. One or more sensors of the AHRS may be disposed within the module body 22, such as but not limited to an accelerometer, gyroscope, and/or magnetometer. The data collected by the AHRS may be used by a control system and/or computing device on the aquatic vehicle 10 to determine a precise location of the instrumentation module 20 and/or one or more instruments of the instrumentation module 20.

The instrumentation module body 22 has a free end 112 and a mounting end 110. In some embodiments, the free end 112 includes one or more fins or other hydrofoil elements that provide a righting force as the instrumentation module 20 moves through water. The righting force may assist in keeping the instrumentation module 20 aligned with the aquatic vehicle 10. The mounting end 110 is configured to mount to the aquatic vehicle 10 via the semi-flexible instrumentation mount 16. For example, in some embodiments of FIG. 1, the semi-flexible instrumentation mount 16 couples the mounting end 110 of the instrumentation module body 22 to the keel 8 of the aquatic vehicle 10 at a mounting location 30 disposed on the keel 8 such that the free end 112 of the instrumentation module 20 extends away from the keel 8 along an axis that is approximately parallel to the primary axis of the vehicle body 2. As an alternative or addition, the semi-flexible instrumentation mount 16 may couple the instrumentation module 20 to the aquatic vehicle 10 at a mounting location 30 disposed on any part of the aquatic vehicle 10 such that the instrumentation module 20 extends from the mounting location 30 in any direction and/or orientation without departing from the spirit or the scope of the disclosure. In some embodiments, the mounting location 30 is selected to orient one or more instruments based on a directionality of the instrument/s and/or a desired direction for data collection. As an alternative or addition, the mounting location 30 may be selected to minimize interference from other components of the aquatic vehicle 10. Such interference may include interference with the operation of one or more instruments disposed on the instrumentation module, hydrodynamic forces, other mechanical interference, acoustic interference, and/or other forms of interference.

In some embodiments, the mounting location 30 is disposed on a surface of the vehicle body 2 and/or hull 4 that is expected to be below a waterline of the aquatic vehicle 10 during typical operation of the aquatic vehicle 10 in a body of water. For example, the mounting location 30 may be disposed on a component of the aquatic vehicle 10 that extends downward from the hull 4 of the aquatic vehicle 10, such as but not limited to the keel 8. In some embodiments, the mounting location 30 is disposed at or near a lowest point of a structural component of the aquatic vehicle 10, such as but not limited to the lower end of the keel 8. For example, the mounting location 30 may be disposed on an end of the keel 8 that is opposite from the end of the keel 8 coupled with the hull 4.

In some embodiments, a distance between the hull and the mounting location 30 is adjustable. For example, when the mounting location 30 is disposed on a feature extending from the hull 4 (such as but not limited to the keel 8), the mounting location 30 may be disposed on an extendable portion of the feature, allowing the distance between the instrumentation module 20 relative to the hull 4 and/or the water surface to be adjustable. The adjustment may be configured to occur during normal operation of the aquatic vehicle 10 and/or when the aquatic vehicle is not deployed in a body of water, such as between deployments and/or during routine maintenance of the aquatic vehicle 10.

Example Semi-Flexible Instrumentation Mount

Figure 2:
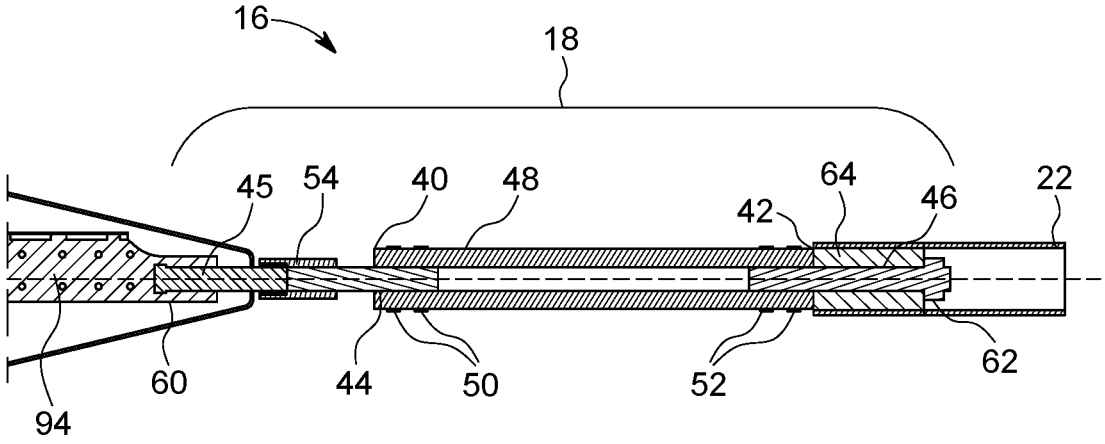
FIG. 2 is a longitudinal cross-sectional view of a semi-flexible instrumentation mount in an example embodiment.

FIG. 2 is a longitudinal cross-sectional view of a semi-flexible instrumentation mount in an example embodiment. The semi-flexible instrumentation mount 16 includes a mounting assembly 18. The mounting assembly 18 has a vehicle end 60 that couples with a mounting location 30 of the aquatic vehicle 10 or an intermediate structure between the mounting location 30 and the vehicle end 60 of the mounting assembly 18, such as a support assembly 94. The mounting assembly 18 has an instrumentation end 62 that couples with the instrumentation module 20 or an intermediate structure between the instrumentation module 20 and the instrumentation end 62 of the mounting assembly 18. In some embodiments, the mounting assembly 18 extends longitudinally between its vehicle end 60 and its instrumentation end 62 along a mounting axis 24. The instrumentation module 20 may be configured to operate below a water line of the aquatic vehicle 10 during normal operation of aquatic vehicle 10. In some embodiments, the instrumentation module 20 operates during navigation of the aquatic vehicle 10. The location and/or orientation of the aquatic vehicle 10 may be used to generate data from the raw data collected by one or more instruments of the instrumentation module 20.

The instrumentation module 20, the semi-flexible instrumentation mount 16, the mounting assembly 18, the mounting location 30, and the aquatic vehicle 10 may be subject to a variety of forces, such as motion and/or vibration generated at the aquatic vehicle 10, impact forces (e.g., from debris, waves, weather and the like), hydrodynamic forces, torsion, strain, axial forces, and other forces. In unmanned vehicles such as USV and UUV, the instrumentation module 20, mounting assembly 18, mounting location 30, and aquatic vehicle 10 may be required to withstand larger forces when operating in environments that are hostile to human operators on manned vehicles of a similar size. Furthermore, an unmanned vehicle may be required to withstand forces over a longer duration without human intervention or routine maintenance, such as when performing an uncrewed remote mission.

The mounting assembly 18 includes an elastomeric segment 48. The elastomeric segment 48 may help to reduce forces on one or more components, such as but not limited to the instrumentation module 20, the semi-flexible instrumentation mount 16, the mounting assembly 18, the mounting location 30, and aquatic vehicle 10, such as by bending in response to external loads or stresses. For example, the flexibility of the elastomeric segment 48 may distribute load or stress more evenly throughout the system. As an addition or alternative, the elastomeric element 48 may provide a righting force that keeps the instrumentation module 20 aligned with the aquatic vehicle 20. The elastomeric segment 48 may be configured to maintain structural integrity over repeated cycles of loading and unloading. The elastomeric segment 48 may comprise one or more elastomeric materials, such as but not limited to chloroprene rubber (CR, also known as neoprene), nitrile rubber (NBR), ethylene propylene diene monomer (EPDM) rubber, silicone rubber, fluoroelastomers (FKM), butyl rubber, and/or other synthetic and/or natural rubbers and/or other polymers (NR). In some embodiments, the elastomeric segment 48 includes or consists of neoprene 75A with a hardness of 75 on the Shore durometer A scale. Neoprene is a synthetic rubber with high resilience, high tensile strength, and high fatigue resistance. Neoprene is suitable for marine environments due to its resistance to weathering, ozone, UV radiation, chemicals, temperature exposure, and saltwater.

The elastomeric segment 48 may be aligned with the mounting axis 24 such that a vehicle end 40 of the elastomeric segment 48 faces the vehicle end 60 of the mounting assembly 18 and an instrumentation end 42 of the elastomeric segment 48 faces the instrumentation end 62 of the mounting assembly 18. As illustrated, the elastomeric segment 48 comprises a cylindrical elastomeric sleeve with a channel through its longitudinal axis. The channel may be hollow or may comprise another material through at least a portion of the channel. In some embodiments, the elastomeric segment 48 is a cylindrical neoprene sleeve with a length of about 18 inches, an outer diameter of about 3 inches, and an inner diameter of about 1 inch. As an alternative or addition, at least a portion of the elastomeric segment 48 may have another cross-sectional shape without departing from the spirit or scope of the disclosure.

The mounting assembly 18 may include a first rigid connector 44 positioned at the vehicle end 60 of the mounting assembly 18 and a second rigid connector 46 positioned at the instrumentation end 62 of the mounting assembly 18. The rigid connector 44 at the vehicle end 60 of the mounting assembly 18 inserts into the elastomeric segment 48 at the vehicle end 40 of the elastomeric segment 48. The rigid connector 46 at the instrumentation end 62 of the mounting assembly 18 inserts into the elastomeric segment 48 at the instrumentation end 42 of the elastomeric segment 48. In some embodiments, the longitudinal axis of the first rigid connector 44, the longitudinal axis of the second rigid connector 46, and the longitudinal axis of the elastomeric segment 48 are aligned along the mounting axis 24. The first rigid connector 44 and the second rigid connector 46 may share one or more properties, or may differ in one or more properties, including type, size, length, width, height, other dimensions, materials, fastening methods, or other properties.

The rigid connectors 44, 46 are coupled to respective ends 40, 42 of the elastomeric segment 48, and may be secured to the elastomeric segment 48 by one or more attachment methods. For example, as described above, the rigid connectors 44, 46 may be secured to the elastomeric segment 48 by one or more threads in a respective end 40, 42 of the elastomeric segment 48, which may be cut by a self-tapping end of the rigid connectors 44, 46 or otherwise formed. As an alternative or addition, the rigid connector 44 at the vehicle end 60 of the mounting assembly 18 may be secured to the vehicle end 40 of the elastomeric segment 48 by one or more clamps 50, such as but not limited to one or more stainless steel band clamps. As an alternative or addition, the rigid connector 46 at the instrumentation end 62 of the mounting assembly 18 is secured to the instrumentation end 42 of the elastomeric segment 48 by one or more clamps 52, such as but not limited to one or more stainless steel band clamps. In some embodiments, one or more high-pressure stainless steel band clamps 50, 52 at the respective ends 40, 42 of the elastomeric segment 48 are configured to compress the respective end 40, 42 over a threaded portion of the respective rigid connector 44, 46 that is inserted into the respective end 40, 42.

The rigid connector 44 may couple the vehicle end 60 of the mounting assembly 18 to a support assembly 94 extending from the mounting location 30 of the aquatic vehicle 10. In some embodiments, the rigid connector 44 at the vehicle end 60 of the mounting assembly 18 is a threaded bolt comprising a shank that is at least partially threaded, including an end of the shank that is rotationally inserted into the vehicle end 40 of the elastomeric segment 48. For example, the rigid connector 44 may be a threaded rod, such as but not limited to a 1⅛×7 threaded rod. As an addition or alternative, the rigid connector 44 may comprise a self-tapping bolt that is designed to cut into and create threads in the elastomeric segment 48. For example, the rigid connectors 44 may cut threads into the surface of an internal channel of the elastomeric segment 48 at the vehicle end 40 of the elastomeric segment 48. In some embodiments, at least a portion of the threaded shank of the rigid connector 44 passes through a coupling nut 54 that functions to join the mounting assembly 18 with a rigid connector 45 extending from the aquatic vehicle 10 at or near the mounting point 30. For example, the rigid connector 45 extending from the aquatic vehicle 10 may be a threaded rod, such as but not limited to a 1⅛×7 threaded rod. The coupling nut 54 joins the rigid connector 54 extending from the aquatic vehicle 10 and the rigid connector 44 extending from the vehicle end 60 of the mounting assembly 18, allowing for the instrumentation array 20 to be removably coupled to the aquatic vehicle 10. In some embodiments, one or more jam nuts are additionally threaded against the coupling nut 54 on one or more sides to prevent movement.

In some embodiments, the rigid connector 46 at the instrumentation end 62 of the mounting assembly 18 is a threaded bolt comprising a shank that is at least partially threaded, including an end of the shank that is rotationally inserted into the instrumentation end 42 of the elastomeric segment 48. For example, the rigid connector 46 may be a threaded rod, such as but not limited to a 1⅛×7 threaded rod. As an addition or alternative, the rigid connector 46 may comprise a self-tapping bolt that is designed to cut into and create threads in the elastomeric segment 48. For example, the rigid connectors 46 may cut threads into the surface of an internal channel of the elastomeric segment 48 at the instrumentation end 42 of the elastomeric segment 48.

The rigid connector 46 may couple the instrument end 62 of the mounting assembly 18 to the instrumentation module body 22 via a body insert 64 configured to couple with the mounting end 110 of the instrumentation module body 22. The body insert 64 may comprise one or more suitable materials, such as but not limited to aluminum, other metals, resin, fiberglass, composite, plastic, another polymer material, and/or any other suitable material. The body insert 64 may be formed using any suitable manufacturing technique, such as but not limited to casting, molding, cutting, forming, extrusion, 3D printing, machining, welding, forging, or any other suitable manufacturing technique. In some embodiments, the body insert 64 is machined from Delrin®, an acetal resin. As an alternative or addition, the body insert 64 may be machined from G10, a fiberglass-reinforced composite material.

In some embodiments, the body insert 64 is inserted into the mounting end 110 of the instrumentation module body 22 after the second rigid connector 46 is inserted through a bolt hole disposed on the body insert 64 and the instrumentation end 42 of the elastomeric segment 48. The bolt hole may pass through approximately the center of the body insert 64. The body insert 64 may be secured to the mounting end 110 of the instrumentation module body 22 by one or more other attachment features and/or methods, such as but not limited to one or more bolts, nuts, screws, rivets, clamps, fasteners, hooks, latches, pins, springs, mounts, interlocking features, magnets, other fasteners, adhesives, bonding agents, heat, welding, soldering, press fitting, friction fitting, and/or any other suitable attachment feature or method.

Figure 3:
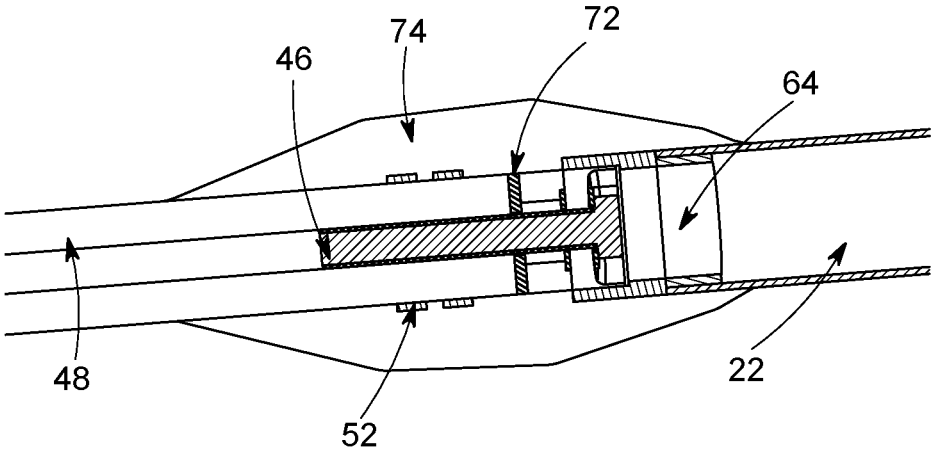
FIG. 3 is a longitudinal cross-sectional view of the instrumentation end of a semi-flexible instrumentation mount in an example embodiment.

In some embodiments, the semi-flexible instrumentation mount 16 includes external reinforcement over one or more junctions. FIG. 3 is a longitudinal cross-sectional view of the instrumentation end of a semi-flexible instrumentation 16 mount in an example embodiment. In some embodiments, the semi-flexible instrumentation mount 16 includes a joint sleeve 74 that covers a junction 72 between the instrumentation end 42 of the elastomeric segment 48 and the instrumentation module body 22. The joint sleeve 74 may be formed from any suitable material, such as but not limited polymer and/or elastomer materials, such as but not limited to CR, NBR, EPDM rubber, silicone rubber, FK), butyl rubber, and/or other synthetic and/or natural rubbers and/or other polymers (NR). In some embodiments, the joint sleeve 74 is formed from urethane 60A. The joint sleeve 74 may be secured to the elastomeric segment 48 and/or the instrument body 22 by one or more other attachment features and/or methods, such as but not limited to one or more bolts, nuts, screws, rivets, clamps, fasteners, hooks, latches, pins, springs, mounts, interlocking features, magnets, other fasteners, adhesives, bonding agents, heat, welding, soldering, press fitting, friction fitting, and/or any other suitable attachment feature or method.

In some embodiments, the joint sleeve 74 is cast in place. For example, the joint sleeve 74 may be cast over the instrumentation end 42 of the elastomeric segment 48 and the mounting end 110 of the instrumentation module body 22 after the instrumentation module body 22 is attached to the instrumentation end 42 of the elastomeric segment 48. In some embodiments, after the mounting end 110 of the instrumentation module body 22 is coupled with the mounting assembly 18: the exposed surfaces near the junction 74 are prepared to facilitate adhesion of the casting material to the exposed surfaces; a mold for the joint sleeve 74 is placed around the junction 72 between the instrumentation module body 22 and the mounting assembly 18; the casting material comprising the joint sleeve 74 is poured into the mold; the casting material is allowed to cure and/or solidify in place; and the mold is removed, resulting in the formation of the joint sleeve 74 that covers the junction 72.

Example Mounting Location

Figure 4:
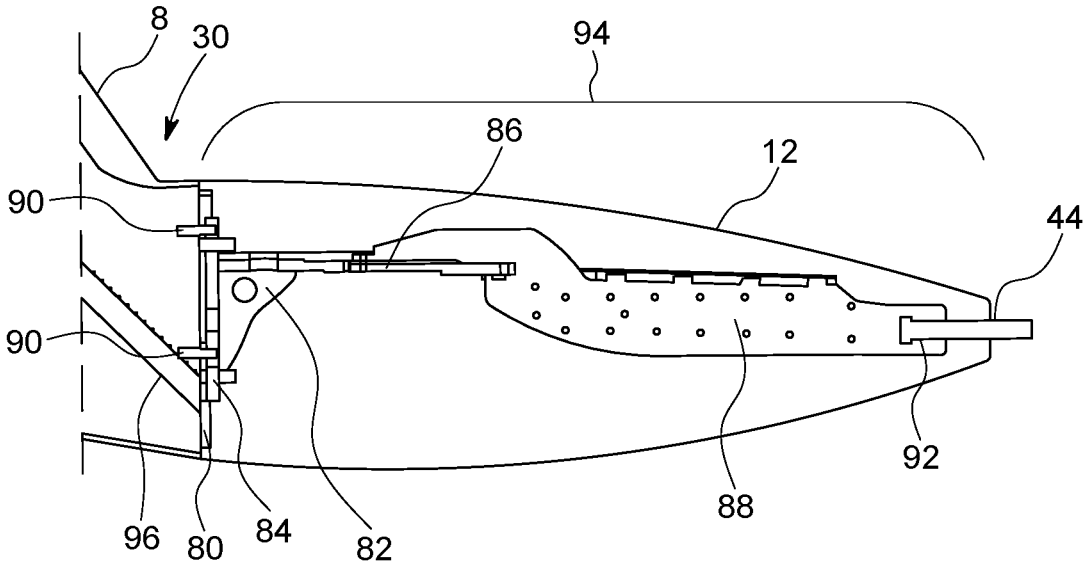
FIG. 4 is a cutaway view of a mounting location on an aquatic vehicle for a semi-flexible instrumentation mount in an example embodiment.

FIG. 4 is a cutaway view of a mounting location on an aquatic vehicle for a semi-flexible instrumentation mount in an example embodiment. In the example embodiment, the mounting location 30 is disposed on the lower end of the keel 8 of the aquatic vehicle 10. The techniques described herein may be adapted to other mounting locations for the semi-flexible instrumentation mount without departing from the spirit or the scope of the disclosure. In the example embodiment, the mounting location 30 includes a keel plate 80. The keel plate 80 is disposed on the lower end of the keel 8. The keel plate 80 may be integrated into the keel 8 and/or attached to the keel 8 using attachment features and/or methods, such as but not limited to one or more bolts, nuts, screws, rivets, clamps, fasteners, hooks, latches, pins, springs, mounts, interlocking features, magnets, other fasteners, adhesives, bonding agents, heat, welding, soldering, press fitting, friction fitting, and/or any other suitable attachment feature or method.

In some embodiments, the semi-flexible instrumentation mount 16 includes a support assembly 94. The support assembly 94 may include one or more support assembly components 82-88. The support assembly components 82-88 may include one or more braces, brackets, plates, beams, bars, columns, trusses, struts, girders, ties, or other structural components. One or of the support assembly components 82-88 may be positioned to provide stability and/or to resist different types of loads acting on the support assembly 94, such as by being placed perpendicular to one or more other support assembly components 82-88.

The support assembly components 82-88 may be manufactured as distinct components that are joined together. As an addition or alternative, two or more of the support assembly components 82-88 may be produced as a single piece. As an addition or alternative, two or more of the support assembly components 82-88 may be joined or otherwise coupled using one or more attachment features and/or methods, such as but not limited to one or more bolts, nuts, screws, rivets, clamps, fasteners, hooks, latches, pins, springs, mounts, interlocking features, magnets, other fasteners, adhesives, bonding agents, heat, welding, soldering, press fitting, friction fitting, and/or any other suitable attachment feature or method.

In some embodiments, the support assembly 94 is coupled to the mounting location 30 at a first end of the support assembly 94. The support assembly 94 may be coupled to the mounting location 30 using one or more attachment features and/or methods, such as but not limited to one or more bolts, nuts, screws, rivets, clamps, fasteners, hooks, latches, pins, springs, mounts, interlocking features, magnets, other fasteners, adhesives, bonding agents, heat, welding, soldering, press fitting, friction fitting, and/or any other suitable attachment feature or method. For example, one or more fasteners 90 may couple a plate component 84 of the support assembly 94 to the keel plate 80 and/or the mounting location 30 on the keel 8.

In some embodiments, the support assembly 94 is coupled to the vehicle end 60 of the mounting assembly 18 at a second end of the support assembly 94. The support assembly 94 may be coupled to the mounting assembly 18 using one or more attachment features and/or methods, such as but not limited to one or more bolts, nuts, screws, rivets, clamps, fasteners, hooks, latches, pins, springs, mounts, interlocking features, magnets, other fasteners, adhesives, bonding agents, heat, welding, soldering, press fitting, friction fitting, and/or any other suitable attachment feature or method. The rigid connector 44 at the vehicle end 60 of the mounting assembly 18 may couple with the support assembly 94 at a fastening location 92 disposed on the support assembly 94. In some examples, the rigid connector 44 is a bolt, and the fastening location 92 includes a threaded or unthreaded bolt hole configured to receive the shank of the rigid connector 44. As an alternative or addition, the rigid connector 44 may be welded to the support assembly 84 at the fastening location 92.

In some embodiments, the keel 8 is at least partially filled with material, such but not limited to ballast material (e.g., lead, concrete, steel, iron, or any other high-density material suitable for use as ballast). The keel 8 may include a wiring channel 96 that passes through such material within the keel 8. In some examples, one or more wires may couple one or more instruments disposed on the instrument module body 22 with one or more control systems, computing devices, and/or power sources on the aquatic vehicle 10. The one or more wires may pass through an interior of the instrument module body 22 and exit the instrument module body 22 at the mounting end 110 of the instrument module body 22. The one or more wires may be routed from the instrumentation of end 62 of the mounting assembly 18 to the vehicle end 60 of the mounting assembly 18 by wrapping the one or more wires in a helix around the exterior of the mounting assembly 18. In some embodiments, the support assembly 94 is configured to secure or otherwise support the one or more wires between the vehicle end 60 of the mounting assembly 18 and the mounting location 30. The one or more wires may enter the aquatic vehicle 10 through the wiring channel 96 at or near the mounting location 30.

In some embodiments, the one or more wires of the instrumentation module 20 may be bundled to form a wire harness that runs through the interior of the instrument module body 22, wraps around the exterior of the mounting assembly 18, runs along the support assembly 94, and runs through the wiring channel 96 to electrically couple the instrument/s of the instrumentation module 20 with control system/s, computing device/s, and/or power source/s on the aquatic vehicle 10.

In some embodiments, the semi-flexible instrumentation mount 16 includes a keel bulb 12 configured to couple with the keel 8 at or near the mounting location 30. When the mounting location 30 is disposed on a different location of the aquatic vehicle 10 other than the keel 8, the semi-flexible instrumentation mount 16 may include a housing element that performs one or more functions of the keel bulb 12 described herein. The keel bulb 12 may cover the mounting location 30, the keel plate 80, and/or the support assembly 94. The keel bulb 12 may improve the hydrodynamics of the semi-flexible instrumentation mount 16, such as by reducing drag by providing a streamlined surface that covers the structural and/or wiring components passing through the keel bulb 12. The surface of the keel bulb 12 may also taper to a size that is approximately the cross-sectional size of the mounting assembly 18 and/or the instrumentation module 20. In some embodiments, the keel bulb 12 may house one or more instruments or other hardware systems, including one or more instruments related to the semi-flexible instrumentation mount 16 and/or the instrumentation module 20.

Example Instrumentation Array

Figure 5:
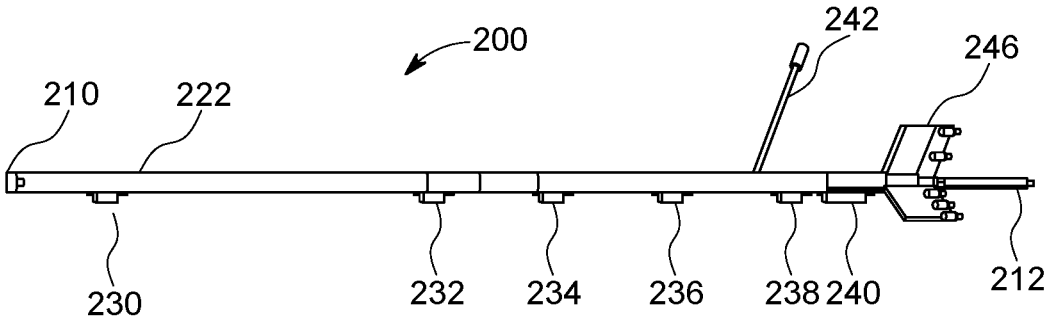
FIG. 5 is a perspective view of an acoustic array module in an example embodiment.

FIG. 5 is a perspective view of an acoustic array module in an example embodiment. The acoustic array module 200 may have one or more properties of the instrumentation module 20 of FIGS. 1-4. For example, the acoustic array module 200 may include a module body 222 having one or more properties of the instrumentation module body 22 of FIGS. 1-4. The module body 222 includes a free end 212 and a mounting end 210 configured to mount to an aquatic vehicle (e.g., aquatic vehicle 10) via a semi-flexible instrumentation mount (e.g., semi-flexible instrumentation mount 16).

The acoustic array module 220 includes one or more sonar system components, such as one or more hydrophones. A hydrophone is an acoustic sensor that is specifically designed to operate in water. It is used to detect and measure underwater sound. Typically, a hydrophone includes a piezoelectric element that converts the pressure variations of sound in the water into an electrical signal. The electrical signal can then be amplified and/or otherwise processed by electronic circuitry to provide a signal that can be analyzed or recorded. While hydrophones are described in example embodiments, the acoustic array module 200 may include one or more transducers without departing from the spirit or the scope of the disclosure. Likewise, the techniques described herein may be applied to passive and/or active sonar systems.

In some embodiments, the acoustic array module 200 includes a linear array of two or more hydrophones 230-240 disposed on a lower surface of the module body 222. As an alternative or addition, the acoustic array module 200 may include hydrophones arranged in another configuration. For example, as an alternative or addition, the acoustic array module 200 may include a tetrahedral sonar array, such as the tetrahedral sonar array of a tetrahedral sonar array module 246.

Figure 6:
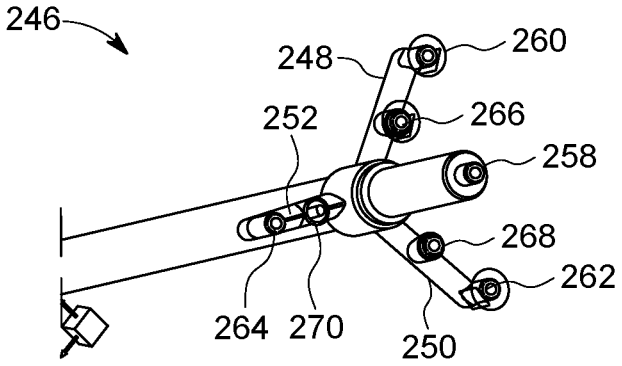
FIG. 6 is a perspective view of a tetrahedral sonar array module disposed at a free end of acoustic array module in an example embodiment.

FIG. 6 is a perspective view of a tetrahedral sonar array module disposed at a free end of acoustic array module in an example embodiment. The tetrahedral sonar array module 246 includes a plurality of hydrophones 258-270 arranged in a tetrahedral configuration. The tetrahedral sonar array module 246 may include a set of hydrofoil elements 248-252 that form a tetrahedral frame. In some examples, the hydrofoil elements 248-252 provide a righting force as the acoustic array module 200 moves through water. The righting force may assist in keeping the acoustic array module aligned with the aquatic vehicle. The hydrophones 258-270 of the tetrahedral sonar array are mounted on the set of hydrofoil elements 248-252. The hydrofoil elements 248-252 help to better optimize the motion of the acoustic array module 200 through water, such as by improving stability. While a 7-element tetrahedral sonar array is shown, the tetrahedral sonar array module 246 may be adapted to support another number of hydrophones, such as but not limited to a 4-element tetrahedral sonar array.

The relative spacing and/or location of the hydrophones 230-240, 258-270 may be used to calculate the direction and location of underwater sound sources. When sound travels through water, it is detected at different times by each hydrophone 230-240, 258-270. By measuring the time differences between the arrival of the sound wave at each hydrophone 230-240, 258-270 in a respective array of hydrophones, the direction and location of the sound source can be calculated using triangulation techniques. Furthermore, by moving the aquatic vehicle and repeating this process at different locations, a bathymetric map of the seafloor can be created based on hydrophone data collected by the hydrophones 230-240, 258-270 and the location and/or orientation of the aquatic vehicle. The location and/or orientation of the aquatic vehicle may be measured by one or more navigational instruments of the aquatic vehicle. The electrical signals generated by the hydrophones 230-240, 258-270 may be transmitted to a control system and/or computing device on the aquatic vehicle, where the electrical signals are processed to calculate data. The calculations take into account the relative location and/or spacing of the hydrophones 230-240, 258-270 in a respective array of hydrophones. In some embodiments, the calculations also take into account AHRS data that includes a location and/or orientation of the acoustic array module 200.

In addition to direction and location, the acoustic array module 200 may be used to measure other properties of the sound field, such as sound intensity, frequency, direction, and/or other properties. This information can be used for environmental monitoring, navigation, mapping, surveys, marine resource management, defense applications, and other purposes. For example, the distance from one or more hydrophones 230-240*m* 258-270 to the seafloor is combined with the known position of the hydrophone 230-240*m* 258-270 and the angle of the acoustic signal. This information is then used to create a three-dimensional map of the seafloor. In addition to bathymetry, chin hydrophones can also be used to detect and map underwater features such as seamounts, ridges, and canyons.

In some embodiments, the acoustic array module 200 includes a noise-cancelling hydrophone 242. The noise-cancelling hydrophone 242 may collect data corresponding to noise generated by the aquatic vehicle. The noise data collected by the noise-cancelling hydrophone 242 maybe used to remove noise from data collected by one or more other hydrophones 230-240, such as by digitally subtracting noise from the output of the one or more other hydrophones 230-240. The noise-cancelling hydrophone 242 may be positioned to optimally detect sound generated by the aquatic vehicle, such as but not limited to sounds caused by the interaction of water and/or debris with the keel, rudder, hull, or other portions of the aquatic vehicle. For example, when the acoustic array module 200 is attached to a surface vehicle, the noise-cancelling hydrophone 242 may be positioned closer to the water surface than the hydrophones 230-240 in the linear array of hydrophones disposed on the lower surface of the module body 222 and/or the hydrophones 258-270 in the tetrahedral sonar array of the tetrahedral sonar array module 246.

OTHER ASPECTS OF DISCLOSURE

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. A semi-flexible instrumentation mount for coupling an instrumentation module to a mounting location disposed on an aquatic vehicle, the semi-flexible instrumentation mount comprising:

a support assembly comprising one or more support assembly components, the support assembly configured to couple with a mounting location disposed on an aquatic vehicle;

an elastomeric segment having a channel, a vehicle end and an instrumentation end;

a first rigid connector configured to insert into the channel at the vehicle end of the elastomeric segment to couple the elastomeric segment with the support assembly; and a second rigid connector configured to insert into the channel at the instrumentation end of the elastomeric segment to couple the elastomeric segment with an instrumentation module.

2. The semi-flexible instrumentation mount of claim 1, wherein a longitudinal axis of the first rigid connector, a longitudinal axis of the second rigid connector, and a longitudinal axis of the channel of the elastomeric segment are aligned.

3. The semi-flexible instrumentation mount of claim 1, wherein the elastomeric segment comprises a synthetic rubber.

4. The semi-flexible instrumentation mount of claim 1:

wherein the first rigid connector comprises a first bolt comprising a first shank that is at least partially threaded;

wherein the first rigid connector is configured to couple with the vehicle end of the elastomeric segment by rotational insertion of a threaded end of the first shank into the channel at the vehicle end of the elastomeric segment.

5. The semi-flexible instrumentation mount of claim 4, wherein the first rigid connector is configured to couple with the support assembly at a fastening location disposed on the support assembly, the fastening location comprising a bolt hole.

6. The semi-flexible instrumentation mount of claim 1:

wherein the second rigid connector comprises a second bolt comprising a second shank that is at least partially threaded;

wherein the second rigid connector is configured to couple with the instrumentation end of the elastomeric segment by rotational insertion of a threaded end of the second shank into the channel at the instrumentation end of the elastomeric segment.

7. The semi-flexible instrumentation mount of claim 6, wherein the second rigid connector is configured to couple with the instrumentation module through a bolt hole of a body insert configured to couple with the instrumentation module.

8. The semi-flexible instrumentation mount of claim 7, wherein the body insert is configured to insert into a mounting end of an instrumentation module body comprising a tube.

9. The semi-flexible instrumentation mount of claim 1, wherein the mounting location is disposed on a lower end of a keel of the aquatic vehicle.

10. The semi-flexible instrumentation mount of claim 9, further comprising a keel bulb configured to cover the mounting location and the support assembly.

11. An instrumentation assembly configured to mount to a mounting location disposed on an aquatic vehicle, the instrumentation assembly comprising:

an instrumentation module comprising an instrumentation module body;

a semi-flexible instrumentation mount for coupling a mounting end of the instrumentation module body to a mounting location disposed on an aquatic vehicle, the semi-flexible instrumentation mount comprising:

a support assembly comprising one or more support assembly components, the support assembly configured to couple with a mounting location disposed on an aquatic vehicle;

an elastomeric segment having an channel, a vehicle end and an instrumentation end;

a first rigid connector configured to insert into the channel at the vehicle end of the elastomeric segment to couple the elastomeric segment with the support assembly; and a second rigid connector configured to insert into the channel at the instrumentation end of the elastomeric segment to couple the elastomeric segment with a mounting end of the instrumentation module body.

12. The instrumentation assembly of claim 11, wherein a longitudinal axis of the first rigid connector, a longitudinal axis of the second rigid connector, a longitudinal axis of the elastomeric segment, and a longitudinal axis of the channel of the instrumentation module body are aligned.

13. The instrumentation assembly of claim 11, wherein the elastomeric segment comprises a synthetic rubber.

14. The instrumentation assembly of claim 11:

wherein the first rigid connector comprises a first bolt comprising a first shank that is at least partially threaded;

wherein the first rigid connector is configured to couple with the vehicle end of the elastomeric segment by rotational insertion of a threaded end of the first shank into the channel at the vehicle end of the elastomeric segment;

wherein the second rigid connector comprises a second bolt comprising a second shank that is at least partially threaded; and wherein the second rigid connector is configured to couple with the instrumentation end of the elastomeric segment by rotational insertion of a threaded end of the second shank into the channel at the instrumentation end of the elastomeric segment.

15. The instrumentation assembly of claim 11, wherein the mounting location is disposed on a lower end of a keel of the aquatic vehicle.

16. The instrumentation assembly of claim 15, further comprising a keel bulb configured to cover the mounting location and the support assembly.

17. The instrumentation assembly of claim 11, wherein the instrumentation module includes a first plurality of hydrophones arranged in a linear array along a lower surface of the instrumentation module body.

18. The instrumentation assembly of claim 11, wherein the instrumentation module includes a second plurality of hydrophones arranged in a tetrahedral array along a tetrahedral sonar array module coupled with a free end of the instrumentation module body.

19. The instrumentation assembly of claim 18, wherein the second plurality of hydrophones are arranged on a tetrahedral frame comprising three hydrofoil elements.

20. The instrumentation assembly of claim 11, further comprising an Attitude and Heading Reference System (AHRS) configured to determine an orientation of the instrumentation module body.

* * * * *